US005564814A

United States Patent [19]

Anderson

[11] Patent Number: 5,564,814

[45] Date of Patent: Oct. 15, 1996

[54] REMOTE CONTROL ILLUMINATION SYSTEM

[76] Inventor: Derek N. Anderson, 4500 39th N. W., #101, Calgary Alberta, Canada, T3A OM5

[21] Appl. No.: 315,243

[22] Filed: Sep. 29, 1994

[51] Int. Cl.[6] ..... F21L 11/00

[52] U.S. Cl. ..... 362/109; 362/183; 362/189

[58] Field of Search ..... 362/20, 85, 98, 362/109, 183, 189, 396

[56] References Cited

U.S. PATENT DOCUMENTS

| | | | |
|---|---|---|---|
| 4,563,727 | 1/1986 | Curiel | 362/183 |
| 4,905,127 | 2/1990 | Kaminski . | |
| 4,949,230 | 8/1990 | Burmeister . | |
| 5,010,462 | 4/1991 | Mintzer . | |
| 5,055,977 | 10/1991 | Acquanetta | 362/109 |
| 5,183,325 | 2/1993 | Hurdle . | |
| 5,188,448 | 2/1993 | Siriani et al. | 362/109 |
| 5,203,622 | 4/1993 | Scottile . | |
| 5,388,692 | 2/1995 | Withrow et al. | 362/109 |

*Primary Examiner*—Denise L. Gromada
*Assistant Examiner*—Sara Sachie Raab
*Attorney, Agent, or Firm*—Chase & Yakimo

[57] ABSTRACT

An illumination device for a household remote control comprising a resiliently flexible C-shaped support having a first end that engages the top surface of the remote control and a second end that engages the bottom surface of the remote control. A light source is supported within the C-shaped support for lighting the top surface of the remote control and is powered by a solar power cell. If the solar power cell fails, a battery provides back-up power to the light source. The C-shaped support also preferably has a window therethrough for allowing the remote signal of the remote control to pass through the window and operate the television or VCR.

10 Claims, 3 Drawing Sheets

REMOTE CONTROL ILLUMINATION SYSTEM

FIELD OF THE INVENTION

This invention relates to a device for illuminating household remote controls commonly used to operate televisions, video cassette recorders (VCRs) and stereos. More specifically, the device is resilient, flexible, attaches to one end of the remote control and includes a solar powered light source which illuminates the control buttons of the remote control.

BACKGROUND OF THE INVENTION

Televisions and VCRs controlled by remote controls have become quite popular. Commonly, people enjoy watching movies and television programs in a darkened room which makes operating the remote control frustrating since the control buttons cannot be seen.

Although at least one remote control made includes lighted controls, it is expensive. Other illuminating devices exist that are attachable to remote controls; however, they are not adaptable for use on all types of remote controls. Furthermore, they may be awkward or cumbersome due to their size and configuration. Finally, they are strictly battery operated. Thus, a need exists for an improved illuminating device adaptable for use with all remote controls.

SUMMARY OF THE INVENTION

Accordingly, a primary object of the invention is to provide an illumination device for a remote control having a resiliently flexible C-shaped body with a first end that engages the top surface of the remote control and a second end that engages the bottom surface of the remote control and thereby clamps the illuminating device to the remote control.

Another object of the invention is to provide an illumination device for a remote control operated by a solar power source.

Yet another object of the invention is to provide an illumination device for a remote control which angularly tilts the remote control upwardly for easy access to the control buttons.

A further object of the invention is to provide an illumination device adaptable for use with any remote control.

Still a further object of the invention is to provide an illumination device which is inexpensive and easy to manufacture.

The foregoing objects are basically attained by providing an illumination device for a remote control having a resiliently flexible C-shaped body with a first end that engages the top surface of the remote control and a second end that engages the bottom surface of the remote control such that the C-shaped body angularly elevates one end of the remote control. The C-shaped body houses a light source for lighting the control buttons on the top surface of the remote control, a solar power source in connection with the light source and a battery powered electrical source in connection with the light source for providing power to the light bulb if the solar source fails. The C-shaped body also includes a window therethrough which allows the remote signal from the remote control to pass through the window and activate the television or VCR.

DETAILED DESCRIPTION

Figure 1:
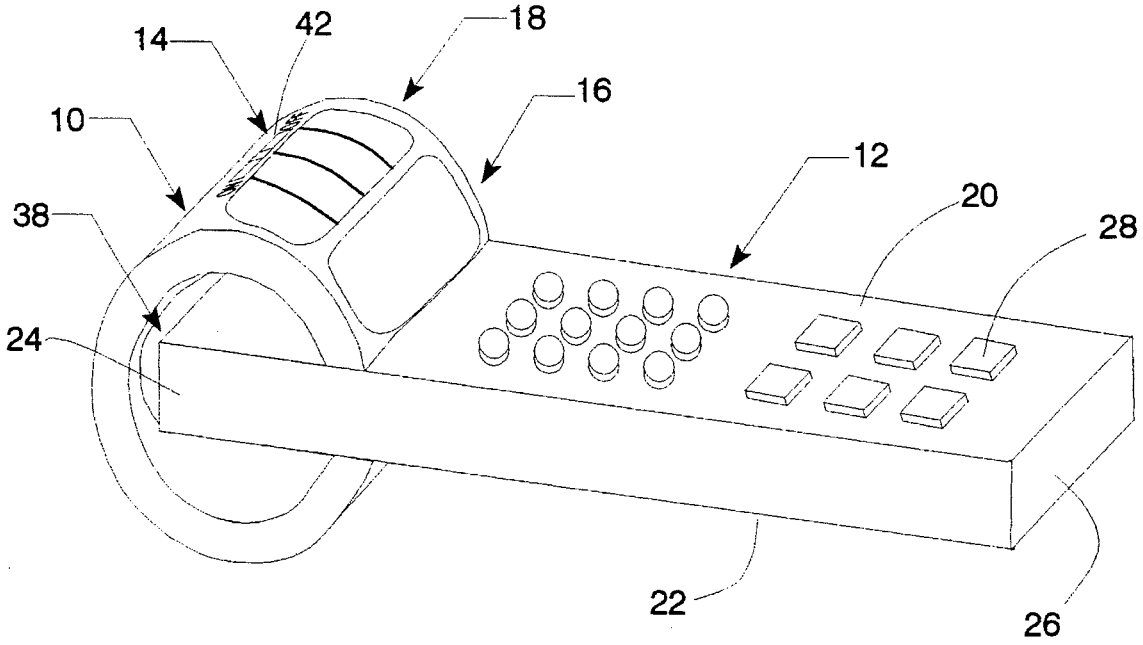
FIG. 1 is a side perspective view of an illumination device in accordance with the present invention assembled on a remote control unit.

An illumination device 10 for lighting the control buttons of a remote control 12, as in FIG. 1, is formed of a C-shaped body 14 adaptable for use with any remote control. The C-shaped configuration of illumination device 10 also angularly elevates the end of the remote control 12 from which the remote signal is projected for easy operation thereof. Illuminating device 10 also includes a light source 16 operated by a solar power cell 18.

As seen in FIG. 1, remote control 12 includes a top surface 20, bottom surface 22, first end 24 and second end 26. The top surface 20 has control buttons 28 extending therethrough. The bottom surface 22 typically rests on a table. The remote control's signal is projected from first end 24 to activate and control the television or VCR.

Figure 2:
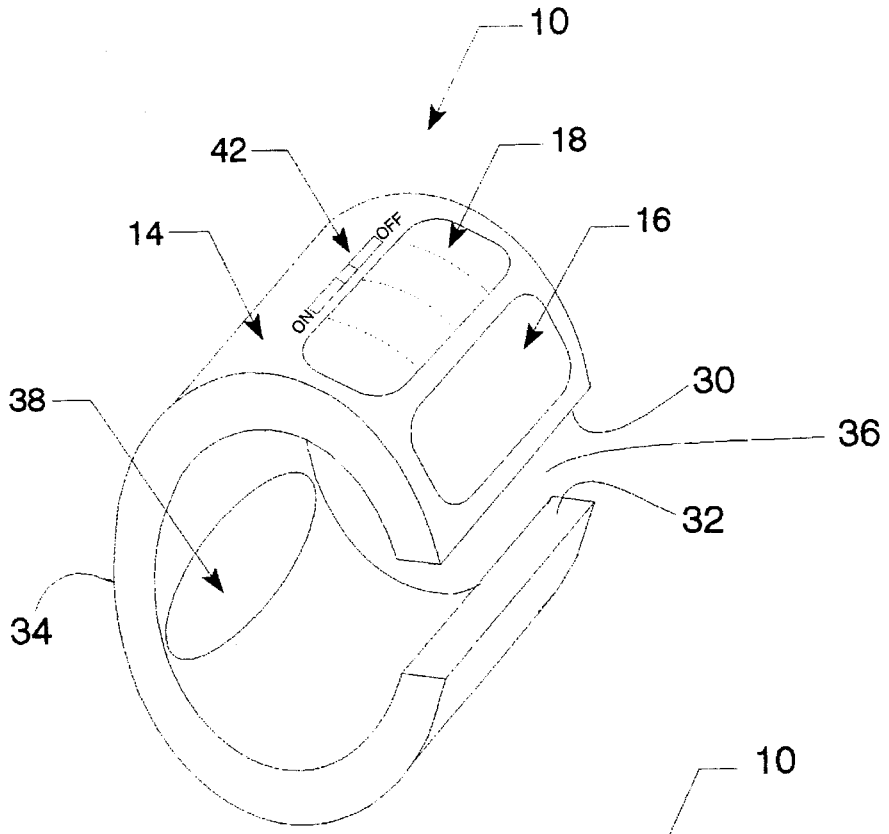
FIG. 2 is a side perspective view of the illumination device of FIG. 1 but with the remote control removed therefrom.
Figure 3:
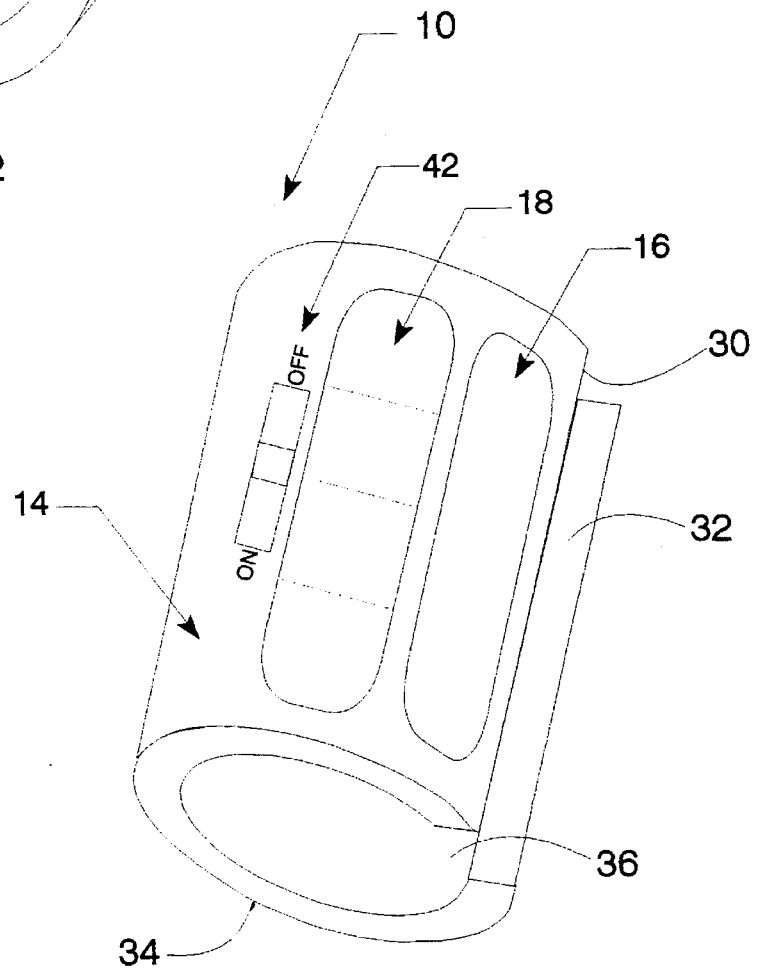
FIG. 3 is a top perspective view of the illumination device of FIG. 2.
Figure 4:
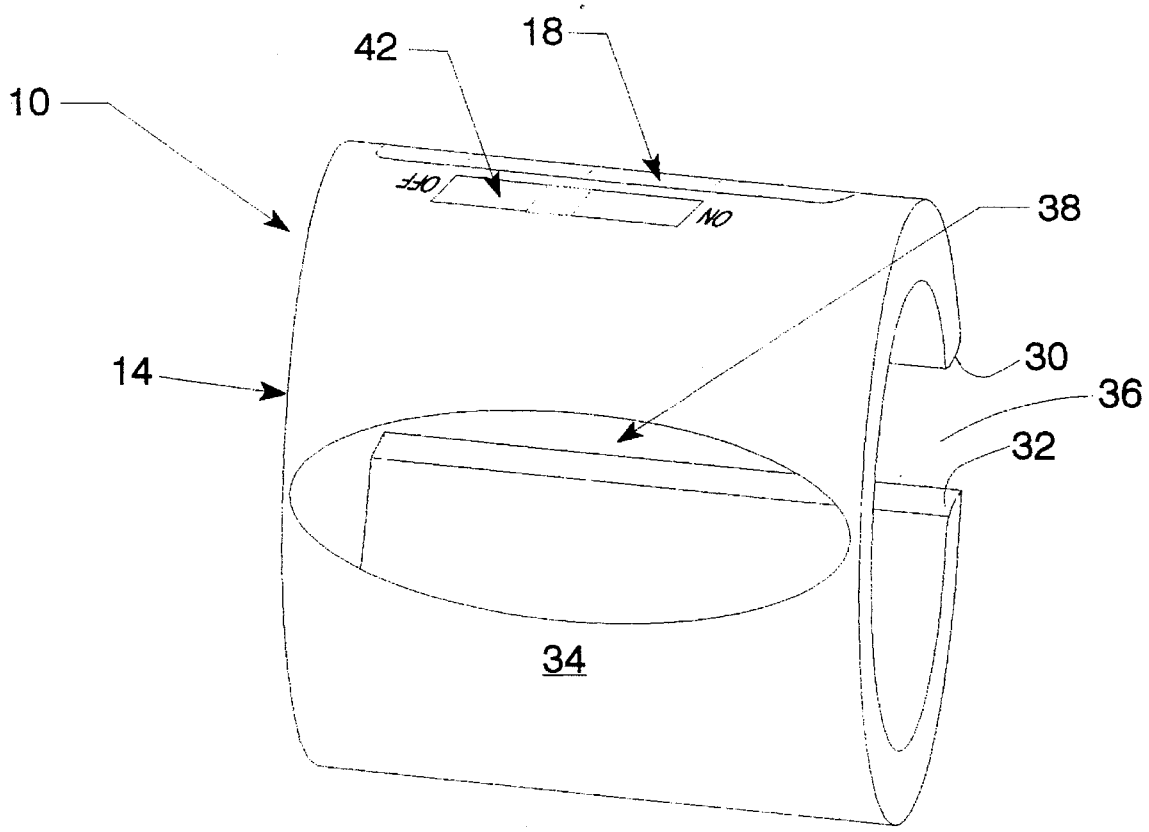
FIG. 4 is a rear perspective view of the illumination device of FIG. 2.

C-shaped body 14 of illuminating device 10 includes a first end 30, second end 32 and rear arched area 34, as seen in FIGS. 2–4. First and second ends 30 and 32 form a gap or opening 36 therebetween into which one end 24 or 26 of the remote control 12 extends. Rear arched area 34 has a window or opening 38 therethrough which allows the remote signal from remote control 12 to pass through C-shaped body 14.

C-shaped body 14 is formed of flexible, resilient and rigid plastic. When being attached to remote control 12, the first and second ends 30 and 32 of C-shaped body 14 flex outwardly and widen opening 36 so that one end 24 or 26 of remote control 12 can be inserted therein. Then, first and second ends 30 and 32 flex inwardly into engagement with the surfaces 20 and 22 of remote control 12 and thereby clamp illuminating device 10 to the remote control 12. Specifically, first end 30 of C-shaped body 14 engages the top surface 20 of remote control 12, and second end 32 of C-shaped body 14 engages the bottom surface 22 of remote control 12.

Preferably, C-shaped body 14 clamps onto the first end 24 of remote control 12 due to the positioning of the control buttons 28. This allows the remote signal from remote control 12 to pass through the window 38 and activate and control the television or VCR. C-shaped body 14 also angularly tilts the remote control 12 upwardly when it rests on a flat surface, such as a table, with the second end 26 of the remote control resting on the table surface and the C-shaped body 14 at the first end 24 of remote control 12 also resting on the table. Alternatively, C-shaped body 14 can clamp onto the second end 26 of remote control 12 if the positioning of the control buttons 28 makes that desirable.

Solar power cells 18 are known and thus need not be described in detail. Solar power cell 18 is supported and housed within C-shaped body 14, as seen in FIGS. 1–4, and stores solar/light energy therein which activates light source 16 when the connection between light source 16 and solar power cell 18 is completed.

Light source or illuminating member 16 is also supported and housed by C-shaped body 14 and is located adjacent the first end 30 of C-shaped body 14 so that it is immediately above the top surface 20 of remote control 12. When the connection between solar power cell 18 and light source 16 is complete, light source 16 illuminates the top surface 20 of remote control 12 which allows easy access and use of the control buttons 28 in a darkened environment. Preferably, light source 16 is a small light bulb.

The connection between solar power cell 18 and light source 16 is completed by switch 42, which is also located within C-shaped body 14, as seen in FIGS. 1–4. Switch 42 moves between an on and off position. When switch 42 is in its on position, the connection between solar power source 18 and light source 16 is completed so that light source 16 illuminates the control buttons 28. When switch 42 is in its off position, the connection between solar power cell 18 and light source 16 is not complete and thus light source 16 is not illuminated.

A backup battery may also be included with light source 16. The battery backs up solar power cell 18 if it fails to provide power to light source 16 upon completion of the connection between light source 16 and solar power cell 18. Thus, the battery is also electrically connected to light source 16 and provides backup power thereto in a conventional manner and need not be described in further detail.

While the preferred embodiment has been chosen to illustrate the invention, it will be understood by those skilled in the art that various changes and modifications can be made therein without departing from the scope of the invention as defined in the appended claims and allowable functional equivalents thereof.

Having thus described the invention, what is claimed as new and desired to be secured by Letters Patent is as follows:

1. An illuminating device for a remote control, comprising:

a body having a first end engageable with a top surface of the remote control, a front portion extending forwardly of and adjacent a front end of the remote control and a second end engageable with a bottom surface of the remote control;

an illuminating means for lighting the top surface of the remote control supported by said body;

an electrical source in connection with said illuminating means for providing power to said illuminating means;

said body including a window formed in said front portion which allows a remote signal to project from the front end of the remote control through said window.

2. An illuminating device as claimed in claim 1, wherein said body angularly elevates the remote control.

3. An illuminating device as claimed in claim 1, wherein said illuminating means is a light bulb.

4. An illuminating device as claimed in claim 1, wherein said body is C-shaped.

5. An illuminating device as claimed in claim 1, wherein said body is resiliently flexible.

6. An illuminating device for a remote control, comprising:

a body having a first end engageable with a top surface of the remote control and a second end engageable with a bottom surface of the remote control;

an illuminating means for lighting the top surface of the remote control supported by said body;

an electrical source in connection with said illuminating means for providing power to said illuminating means;

said body including a window which allows a remote signal from the remote control to pass through said body; and said electrical source being solar powered.

7. An illuminating device for a remote control, comprising:

a resiliently flexible body having a first end engageable with a top surface of the remote control and a second end engageable with a bottom surface of the remote control so that said body angularly elevates the remote control;

an illuminating means for lighting the top surface of the remote control housed within said body;

a solar powered electrical source housed within said body and in connection with said illuminating means for providing power to said illuminating means, said body having a window which allows a remote signal from the remote control to pass through said body.

8. An illuminating device for a remote control, comprising:

a body having a first end and a second end which form an opening therebetween;

an illuminating means for lighting the top surface of the remote control; and an electrical source housed within said body and in connection with said illuminating means for providing power to said illuminating means;

said first and second ends being flexible between a first unassembled position and a second assembled position so that said first end engages a top surface of the remote control and said second end engages a bottom surface of the remote control when said first and second ends are in said assembled position and thereby clamp said body onto the remote control;

said body including a front portion extending forwardly of and adjacent a front end of the remote control and having a window formed therein through which a remote signal from the front end of the remote control projects.

9. An illuminating device as claimed in claim 8, wherein said body is C-shaped.

10. An illuminating device for a remote control, comprising:.

a body having a first end and a second end which form an opening therebetween;

an illuminating means for lighting the top surface of the remote control; and an electrical source housed within said body and in connection with said illuminating means for providing power to said illuminating means;

said first and second ends being flexible between a first unassembled position and a second assembled position so that said first end engages a top surface of the remote control and said second end engages a bottom surface of the remote control when said first and second ends are in said assembled position and thereby clamp said body onto the remote control;

said body including a window through which a remote signal from the remote control projects;

said body being resiliently flexible and said electrical source is solar powered.

* * * * *